US010113295B2

(12) United States Patent
Zimmermann et al.

(10) Patent No.: US 10,113,295 B2
(45) Date of Patent: Oct. 30, 2018

(54) WORK MACHINE FOR DRAGLINE BUCKET OPERATION

(71) Applicant: Liebherr-Werk Nenzing GmbH, Nenzing (AT)

(72) Inventors: Johann Zimmermann, Feldkirch (AT); Tizian Lamprecht, Bludesch (AT)

(73) Assignee: Liebherr-Werk Nenzing GmbH, Nenzing (AT)

( * ) Notice: Subject to any disclaimer, the term of this patent is extended or adjusted under 35 U.S.C. 154(b) by 232 days.

(21) Appl. No.: 14/581,427

(22) Filed: Dec. 23, 2014

(65) Prior Publication Data

US 2015/0184357 A1 Jul. 2, 2015

(30) Foreign Application Priority Data

Dec. 27, 2013 (DE) ..... 10 2013 022 108

(51) Int. Cl.

| | |
|---|---|
| ***E02F 3/60*** | (2006.01) |
| ***B65H 75/44*** | (2006.01) |
| ***E02F 3/48*** | (2006.01) |
| ***E02F 3/58*** | (2006.01) |
| ***E02F 9/20*** | (2006.01) |

(52) U.S. Cl.

CPC ..... *E02F 3/60* (2013.01); *B65H 75/4407* (2013.01); *E02F 3/48* (2013.01); *E02F 3/58* (2013.01); *E02F 9/2016* (2013.01)

(58) Field of Classification Search

CPC ..... E02F 3/48; E02F 3/58; E02F 3/60; E02F 9/2016; B65H 75/4407

USPC ..... 254/389

See application file for complete search history.

(56) References Cited

U.S. PATENT DOCUMENTS

| | | | | | |
|---|---|---|---|---|---|
| 1,516,878 | A * | 11/1924 | Armstrong | E02F 3/48 | 37/395 |
| 1,572,228 | A * | 2/1926 | Burke | E02F 3/48 | 242/397.3 |
| 1,929,417 | A * | 10/1933 | Fykse | B66D 1/36 | 254/397 |
| 2,272,917 | A * | 2/1942 | Lawier | B66D 1/36 | 242/157.1 |
| 2,599,926 | A * | 6/1952 | Le Bus | B65H 75/265 | 242/602.2 |
| 2,602,245 | A * | 7/1952 | Nickles | E02F 3/58 | 212/167 |

(Continued)

FOREIGN PATENT DOCUMENTS

| | | | |
|---|---|---|---|
| DE | 523086 | C | 4/1931 |
| DE | 921496 | C | 12/1954 |

(Continued)

OTHER PUBLICATIONS

German Patent and Trademark Office, Search Report of DE102013022108.0, dated Jul. 21, 2014, 10 pages.

*Primary Examiner* — Jessica H Lutz
(74) *Attorney, Agent, or Firm* — McCoy Russell LLP

(57) ABSTRACT

A work machine, in particular a cable-operated excavator, for dragline bucket operation, a dragline bucket taken up by a hoist rope, wherein the attachment can be retracted by at least one dragline for carrying out the dragging movement and a dragline guide for guiding the dragline is arranged at the work machine, wherein the dragline guide is designed as movable, in particular as linearly movable.

19 Claims, 6 Drawing Sheets

(56) References Cited

U.S. PATENT DOCUMENTS 3,006,608 A * 10/1961 Cimino ..... E02F 3/48 254/395
3,608,865 A * 9/1971 Kirk ..... B66D 1/20 172/26.5
3,708,152 A * 1/1973 Bulin ..... B66D 1/36 254/327
3,800,612 A * 4/1974 Fulghum ..... A01D 34/6812 474/135
3,912,230 A * 10/1975 Learmont ..... E02F 3/58 254/285
4,171,640 A * 10/1979 van Mastrigt ..... G01L 5/107 73/862.451
4,469,171 A * 9/1984 Mine ..... E21B 19/22 166/85.5
4,634,328 A * 1/1987 Carrell ..... B07C 1/04 198/444
4,760,992 A * 8/1988 Peppel ..... B63B 21/16 242/155 R
5,226,249 A * 7/1993 Pippins ..... E02F 3/58 200/332
5,471,772 A * 12/1995 Blaszynski ..... E02F 3/58 294/82.11
6,067,735 A * 5/2000 Kallenberger ..... E02F 3/58 254/398
6,082,710 A * 7/2000 Dragsund ..... B63B 35/04 254/134
6,401,370 B1 * 6/2002 Blom ..... E02F 3/4135 37/142.5
8,887,414 B2 * 11/2014 Baker ..... E02F 3/48 254/392
2011/0108786 A1 * 5/2011 Meijer ..... B66D 1/36 254/278
2013/0195596 A1 * 8/2013 Brenny ..... E02F 3/36 414/722

FOREIGN PATENT DOCUMENTS

DE 29620129 U1 1/1997
GB 1285912 A 8/1972
GB 1558938 A 1/1980

* cited by examiner

WORK MACHINE FOR DRAGLINE BUCKET OPERATION

CROSS REFERENCE TO RELATED APPLICATION

This application claims priority to German Patent Application No. 10 2013 022 108.0, entitled "Work Machine for Dragline Bucket Operation," filed Dec. 27, 2013, which is hereby incorporated by reference in its entirety for all purposes.

TECHNICAL FIELD

The present disclosure relates to a work machine, in particular to a cable-operated excavator, for dragline bucket operation, comprising a dragline bucket taken up by a hoist rope, wherein the bucket can be retracted by means of at least one dragline for carrying out the dragging movement and a dragline guide for guiding the dragline at the work machine.

The present disclosure relates to the dragline bucket attachment of a work machine, in particular of a cable-operated excavator. The term "scraping" or "scraper attachment" is also used in the technical literature. Work machines or cable-operated excavators are equipped for this purpose with a so-called dragline bucket or also a dragline digger as the piece of working equipment. The bucket, which is trough-shaped as a rule, is connected to the machine by two ropes, namely the hoist rope and the dragline. The dragline bucket is cast as far away from the machine as possible via the hoist rope. The dragline runs directly from the superstructure of the work machine or of the excavator to the fastening point at the dragline bucket, with a dragging movement of the bucket along the earth's surface being achieved by retracting the dragline and the superficial earth material being taken up through the bucket opening.

The dragline bucket can subsequently be raised by the hoist rope with a taut dragline and can be emptied at the emptying location by slackening the dragline.

BACKGROUND AND SUMMARY

In previous machine designs for dragline bucket operation, standard winches having special grooves were used for the dragline. The dragline is in this respect guided on the dragline winch via a dragline guide fixedly installed at the excavator superstructure.

To be able to observe the maximum permitted angle of departure of the dragline from the winch, the dragline guide must have a minimum spacing from the winch. With large winches, this means that the dragline guide has to be projected by a large amount in front of the machine.

It is the object of the present disclosure to disclose a possibility for an improved dragline guide which allows operation with lower wear as well as a higher flexibility with respect to the dragline winch used.

In accordance with the present disclosure, a work machine, in particular a hydraulic cable-operated excavator, for dragline bucket operation is proposed, wherein the work machine has a dragline bucket attachment taken up by the hoist rope. In addition, the work machine comprises a dragline which can be actuated and which is fastened at the end side to the dragline bucket attachment. A dragging movement of the dragline bucket attachment can be carried out by retracting the dragline. The dragline in particular runs from the superstructure of the work machine or of the cable-operated excavator to the dragline bucket attachment, while the hoist rope is guided via the boom tip of the cable-operated excavator to the dragline bucket attachment.

In accordance with the present disclosure, a dragline guide for guiding the dragline in the region of the body of the work machine or of the excavator body is provided, in particular in the region of the excavator superstructure, said dragline guide being designed as movable, in particular as linearly movable, so that the guide direction of the dragline guide is adjustable. The dragline guide is in particular designed as linearly movable relative to the work machine. The dragline guide serves the regulation of the deflection angle of the dragline on a dragline winch. The deflection angle of the dragline on the dragline winch can be varied by the linearly movable arrangement of the dragline guide at the work machine or at the cable-operated excavator; the deflection angle can in particular be kept as small as possible. The wear of the dragline and/or of the dragline winch can be reduced by the minimization of the deflection angle. In addition, the present disclosure allows a higher flexibility in the selection of a suitable winch shape or winch type as well as with respect to the positioning of the dragline winch at the cable-operated excavator.

A dragline winch having a Lebus grooving is particularly preferably used which allows a multilayer winding of the dragline for dragline bucket operation.

In an advantageous embodiment, the dragline guide is movable or shiftable transversely to the guide direction, i.e. transversely to the rope extent of the dragline, that is in the horizontal direction. The lateral guide of the dragline can thereby be simply regulated to keep the deflection angle of the dragline in a tolerable range with respect to the dragline winch.

It is particularly advantageous if one or more drive elements, such as electrical and/or hydraulic motors and/or hydraulic cylinders, are arranged at or in the region of the dragline guide to allow an automatic linear movement or an automatic shifting of the dragline guide. The arrangement of one or more drive elements moreover allows an automated control and/or regulation of the dragline guide during dragline bucket operation.

Hydraulically or electrically actuable actuators or control adjustment cylinders can be considered as drive elements. However, other types of drive elements for the automatic adjustment of the dragline guide are conceivable for the implementation of the idea in accordance with the present disclosure as long as the required forces for carrying out the adjustment movement and/or for maintaining the position of the dragline guide can be applied.

In accordance with a further advantageous embodiment of the present disclosure, an electronic controller may be provided for controlling the one or more drive elements. The automated control and/or regulation of the adjustment movement of the dragline guide during dragline bucket operation is achieved via the controller via one or more sensor and/or actuator elements. The adjustment movement of the dragline guide is optionally controlled or regulated by the controller in dependence on the detected rope deflection angle of the dragline with respect to the dragline winch. The rope deflection angle can, for example, be detected by a suitable sensor system, wherein the sensor system is in indirect or indirect communication with the controller for the measured value transfer.

The one or more controllers optionally comprises control logics which carry out a control of the one or more drive elements so that a winding up of the dragline takes place at a deflection angle lying in the tolerance range. The controller may in particular minimize the oblique pull of the dragline on the dragline winch as much as possible.

In an advantageous embodiment, the dragline guide comprises at least one upper and at least one lower rope pulley. The axes of rotation of the rope pulleys lie in parallel with one another. The at least two rope pulleys are advantageously arranged above one another; the dragline runs through the gap formed between the two rope pulleys. In addition to the arrangement of the pulley head of the dragline guide at the work machine which is linearly movable in accordance with the present disclosure, it can moreover be arranged pivotable with respect to the work machine, in particular over a pivot angle of 360° . The rope pulleys have horizontal axes of rotation in the starting position.

The dragline guide additionally or alternatively comprises at least two roller bodies which are disposed opposite one another and are arranged in parallel with one another. The roller body can be supported or arranged rotatably or fixedly at the dragline guide. Ideally, the at least two oppositely disposed roller bodies are arranged at the front rope inlet region of the dragline guide. The lateral deflection of the dragline is prevented or limited with the aid of the roller bodies which are perpendicular in the starting position of the dragline guide. The axes of rotation of the roller bodies extend perpendicular to the axes of rotation of the rope pulleys. In the preferred embodiment, the dragline runs between the formed gap of the oppositely disposed roller bodies to the subsequently arranged rope pulleys.

In addition to the work machine or to the cable-operated excavator, the present disclosure relates to a dragline guide for a work machine or cable-operated excavator in accordance with the present disclosure or with an advantageous embodiment of the present disclosure. The dragline guide accordingly has the same advantages and properties as the work machine in accordance with the present disclosure, so that a repeat description will be dispensed with at this point.

In a preferred embodiment, the dragline guide is designed as releasably connectable to the work machine or to the cable-operated excavator, in particular to the superstructure of the cable-operated excavator. An arrangement at the pivotal connection piece of the superstructure is conceivable.

In accordance with a further preferred development of the present disclosure, the maximum rope angle of the dragline on the winch can be ensured by the correct positioning of the adjustment device. For this purpose, a direction-dependent movement of the winch can be recognized via a measuring device on the winch. A control computer can now calculate the current rope departure position above the winch with the aid of the known geometrical data of the winch. The adjustment device of the dragline guide can thus be set to the correct position. The adjustment device is positioned such that the deflection angle of the rope on the winch amounts to zero degrees where possible or such that the maximum permitted deflection angle is not exceeded in any case. The current position of the adjustment device can be measured back via a further measuring device and can optionally be corrected.

Further advantages and properties of the present disclosure will be explained in more detail with reference to an embodiment shown in the drawings.

BRIEF DESCRIPTION OF THE FIGURES

FIGS. 1-4 are drawn to scale, although other relative dimensions may be used, if desired.

DETAILED DESCRIPTION

Figure 1:
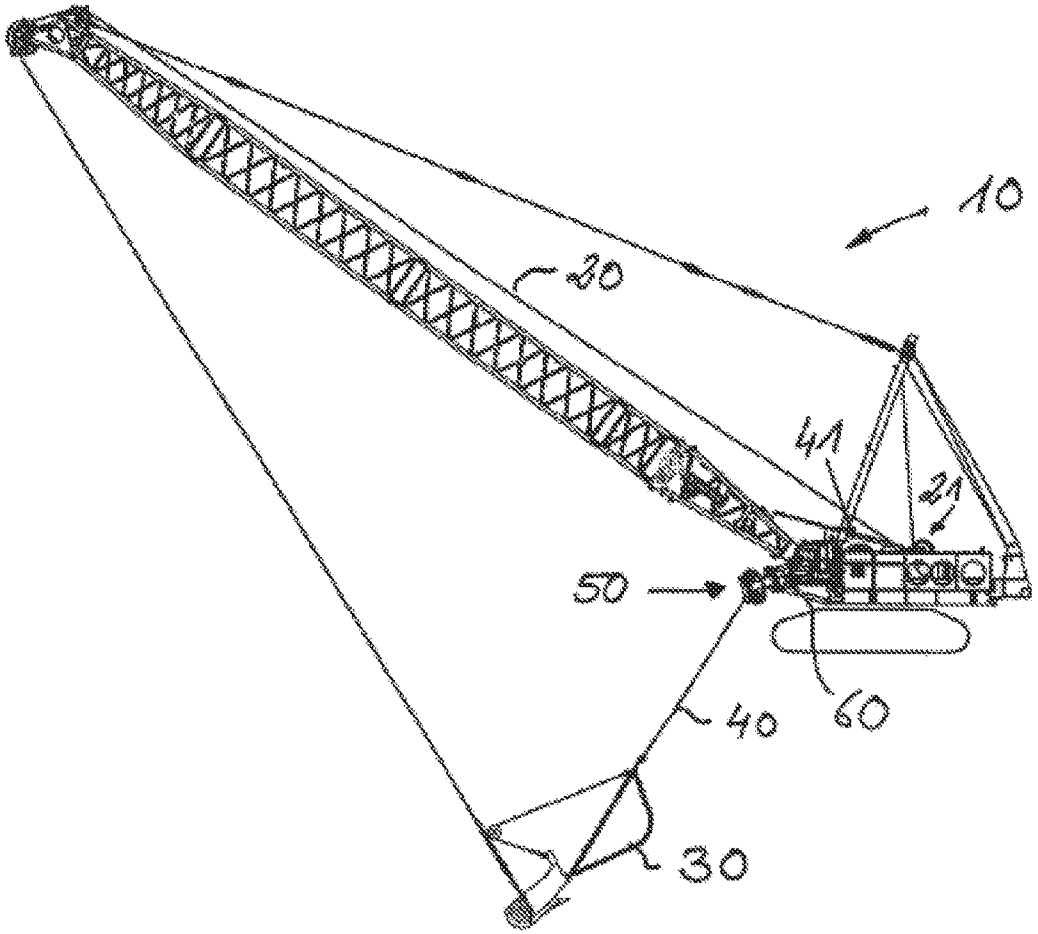
FIG. 1 shows a side view of the cable-operated excavator in accordance with the present disclosure during dragline bucket operation.

FIG. 1 shows a side view of the cable-operated excavator in accordance with the present disclosure for dragline bucket operation. The present disclosure will be explained in the following with reference to a cable-operated excavator. The dragline guide used can, however, be used generally as a piece of working equipment for any work machine as long as the required conditions of the work machine, for example a hoist rope, are present.

The cable-operated excavator 10 shown is configured as a crawler excavator. The hoist rope 20 is guided, starting from the superstructure of the crawler excavator 10, via the lattice mast boom and the roller head arranged at the tip, up to the dragline bucket 30. The dragline bucket 30 can be raised via the hoist rope 20 and can be cast with a distance from the superstructure which is as large as possible. The actuation of the hoist rope 20 takes place by means of the hoist rope winch 21.

The dragline bucket 30 is moreover connected to the dragline 40 of the cable-operated excavator 10, said dragline being able to be wound up and unwound by a dragline winch 41 arranged at the superstructure. The retraction movement of the dragline 40 produces a dragging movement of the dragline bucket 30. The dragline bucket 30 shown is shaped in the form of a trough and drags along its contact surface with the bucket opening to the front, over the earth's surface, when the dragline 40 is retracted so that the inner space of the bucket 30 is filled with the earth material to be taken up.

A dragline guide 50 by which the dragline 40 is guided, starting from the bucket 30, up to the dragline winch 41, is arranged at the pivotal connection piece 60 of the excavator superstructure.

Figure 2:
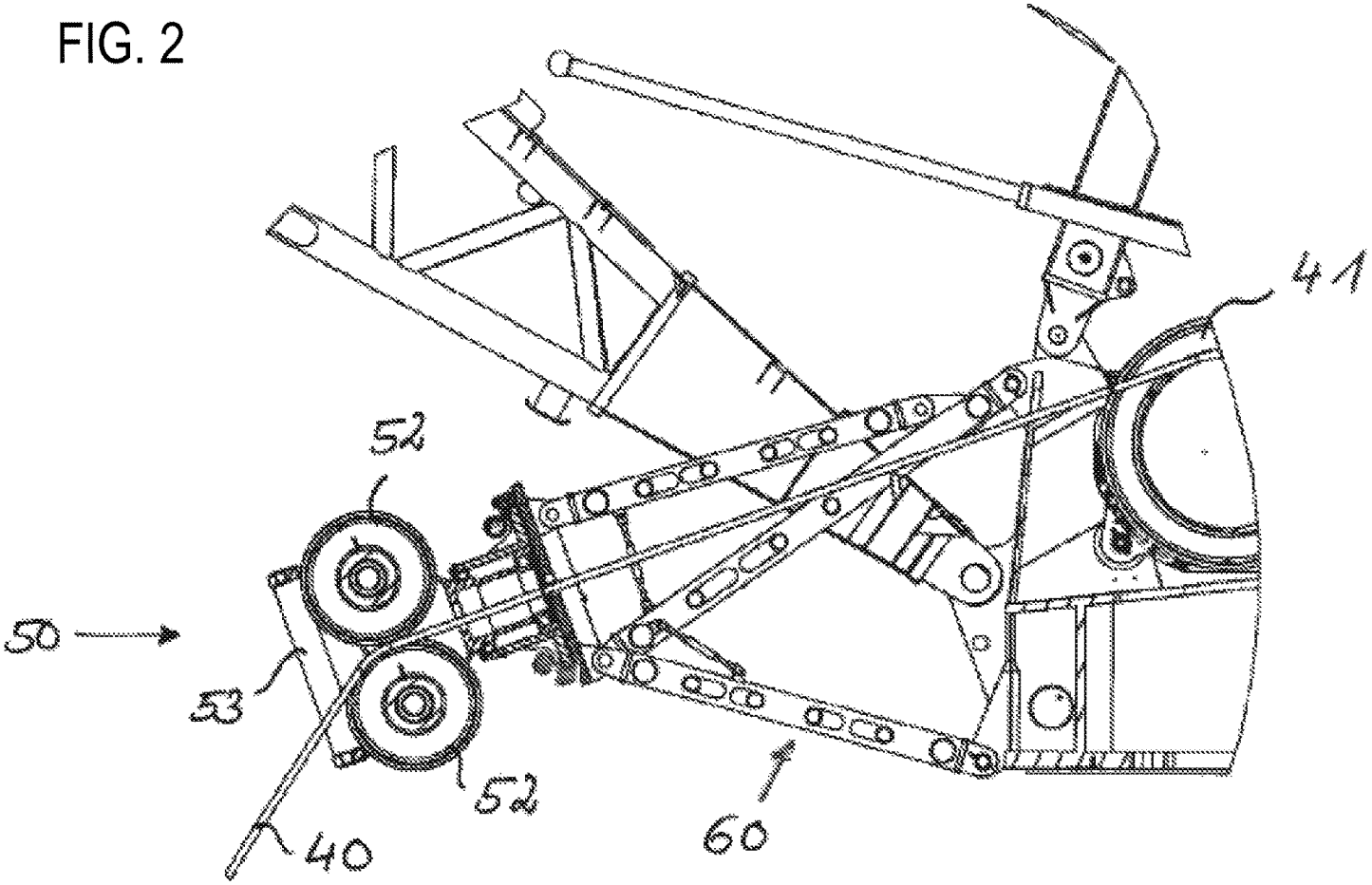
FIG. 2 shows a sectional representation through the dragline guide in accordance with the present disclosure.

A sectional view of the dragline guide 50 in accordance with the present disclosure along a vertical sectional plane can be seen from FIG. 2. The two rope guide pulleys 52 can be recognized which are arranged above one another and which form a gap in the adjacent region through which the dragline 40 is guided. The axes of rotation of the two rope pulleys 52 are arranged in parallel with one another and both lie in the horizontal plane. The direction of rotation of the rope pulleys is in the opposite direction.

Two oppositely disposed rollers 53 are provided at the inlet of the dragline guide and bound the lateral deflection angle of the dragline 40 in the horizontal plane. The rollers 53 have vertical axes of rotation which are arranged in parallel with one another, with only one of the two rollers 53 being able to be recognized in FIG. 2 due to the sectional representation.

The total dragline guide is fastened to the pivotal connection piece 60 of the superstructure. The dragline winch 41 onto which the dragline 40 is wound up can be recognized at the right Figure margin. The dragline winch 41 has a so-called Lebus grooving which allows a multiple winding of the dragline 40 in dragline operation.

Figure 3:
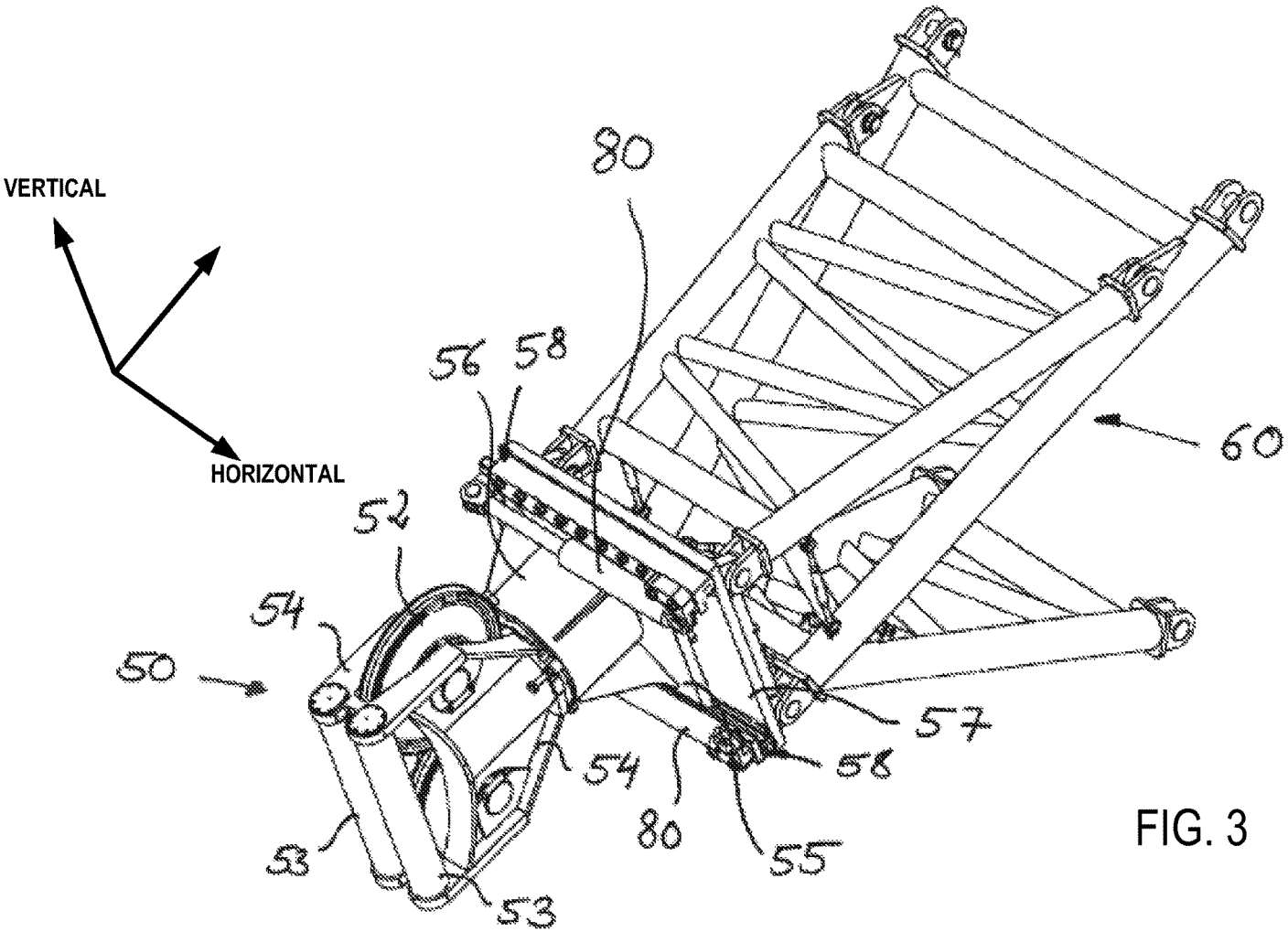
FIG. 3 shows a perspective detailed view of the dragline guide in accordance with the present disclosure.

The arrangement of the dragline guide 50, which is movable or adjustable with respect to the cable-operated excavator or to the pivotal connection piece 60, can be explained with reference to the perspective representation of FIG. 3. The rope pulleys 52 of the dragline guide 50 are received between the two side plates 54 at whose frontmost point a respective one of the above-described rollers 53 is rotatably clamped.

Both side plates 54 are designed as tapered on the side facing the pivotal connection piece 60 to be taken up by the tubular receiver 56 of the base plate 55. The base plate 55 of the dragline guide 50 is moreover supported relatively displaceable to the pivotal connection plate 57 via two guide rails 58 of the pivotal connection plate. The base plate 55 can be displaced in the horizontal direction with respect to the pivotal connection piece 60 by means of the guide rails 58. The pivotal connection plate 57 is releasably bolted to the pivotal connection piece via the bolt points 61 so that, on regular cable-operated excavator operation, the dragline guide 50 could be removed or an existing cable-operated excavator could be simply retrofitted with a suitable pivotal connection piece.

The displacement is effected by two hydraulically releasable adjustment cylinders 80 which are connected to the pivotal connection plate 57 at the cylinder side and to the base plate at the piston side. Both cylinders 80 are in parallel with one respective guide rail 58. In the center position of the piston, the guide axis of the dragline guide 50 is flush with the central axis of the pivotal connection piece 60. The dragline guide 50 can be shifted to the right or to the left in the horizontal direction with respect to the central axis of the pivotal connection piece 60 by a moving out or moving in movement.

In addition, the dragline guide 50 can be pivoted with respect to the cable-operated excavator 10 or the tubular receiver 56. The roller head of the dragline guide 50 comprising side plates 54, pulleys 52 and rollers 53 can be pivoted about a pivot angle of 360°, for example.

Figure 4:
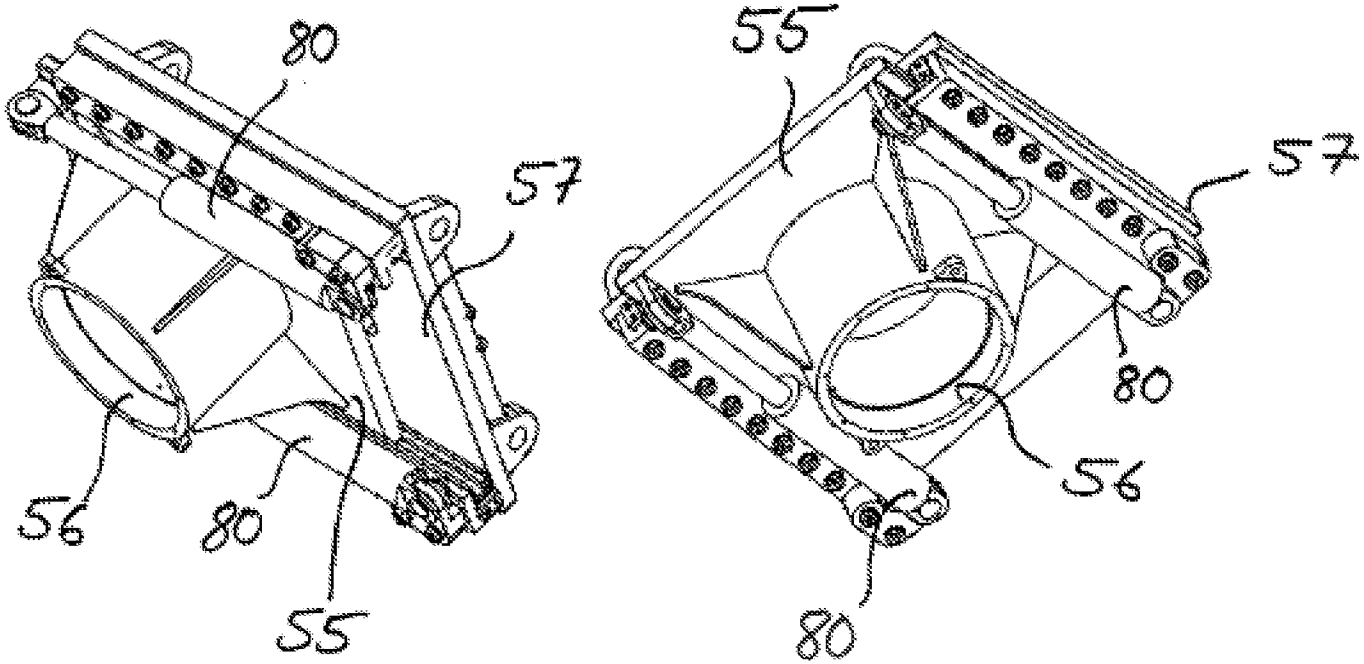
FIG. 4 shows two detailed views of the drive mechanism of the dragline guide in accordance with the present disclosure.

A further detailed view of the base plate 55 and of the pivotal connection plate 57 can be seen from the two representations of FIG. 4. Both representations show the combination of base plate and pivotal connection plate 55, 57 without the received side plates 54, including the pulley arrangement 52, 53 of the dragline guide 50. The two hydraulic adjustment cylinders 80 can be recognized which are inwardly fastened next to the guide rails 58 and are bolted to the base plate 55 at the piston side and to the pivotal connection plate 57 at the cylinder side.

The actuation of the hydraulic adjustment cylinders 80 takes place by the central control unit of the cable-operated excavator. The shift movement of the dragline guide 50 is in this respect controlled or regulated such that a minimal deflection angle of the wound up dragline is maintained with respect to the dragline winch 41. The wear of the dragline 40 and of the dragline winch 41 can thereby be reduced. In addition, the movable design of the dragline guide 50 allows the use of a dragline winch 41 having Lebus grooving, whereby a multilayer winding is also possible for the dragline winch 41.

Figure 5:
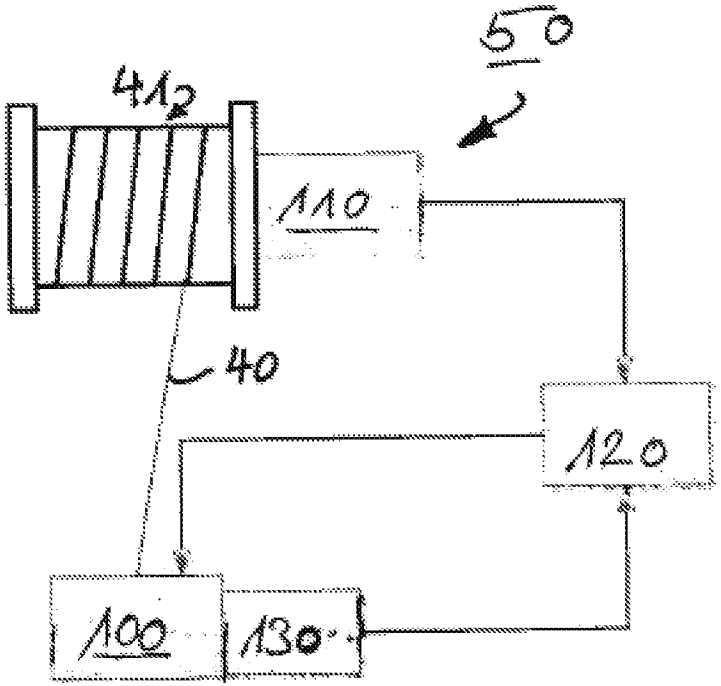
FIG. 5 shows a schematic representation of a dragline guide.

A control behavior for controlling the dragline guide 50 can be described with reference to the schematic representation in FIG. 5. The maximum rope angle of the dragline 40 on the dragline winch 41 can be ensured by the correct positioning of the adjustment device 100 of the dragline guide 50. For this purpose, a direction-dependent movement of the dragline winch 41 can be recognized via a measuring device 110 on the dragline winch 41. A control computer 120 can now calculate the current rope departure position from the dragline winch 41 with the aid of the known geometrical data of the dragline winch 41. The adjustment device 100 of the dragline guide 50 can thus be set to the correct position. The adjustment device 100 is positioned such that the deflection angle of the dragline 40 on the dragline winch 41 amounts to zero degrees where possible or such that the maximum permitted deflection angle is not exceeded in any case. The current position of the adjustment device 100 can be measured back via a further measuring device 130 and can optionally be corrected.

The winch movement has to be detected so that the control computer 120 can calculate the current rope departure position. The speed of the dragline winch 41 and the direction of rotation of the dragline winch 41 are detected by the measuring device. An incremental encoder, not shown in any more detail here, or a speed of rotation measurement via proximity switches can be used as the measuring device, for example.

A path measurement on the adjustment device 100 is used for a back measurement of the current position of the adjustment device 100. Said adjustment device delivers the current position to the control computer. An integrated cylinder path measurement can, for example, be used on an adjustment via a cylinder 80.

Figure 6:
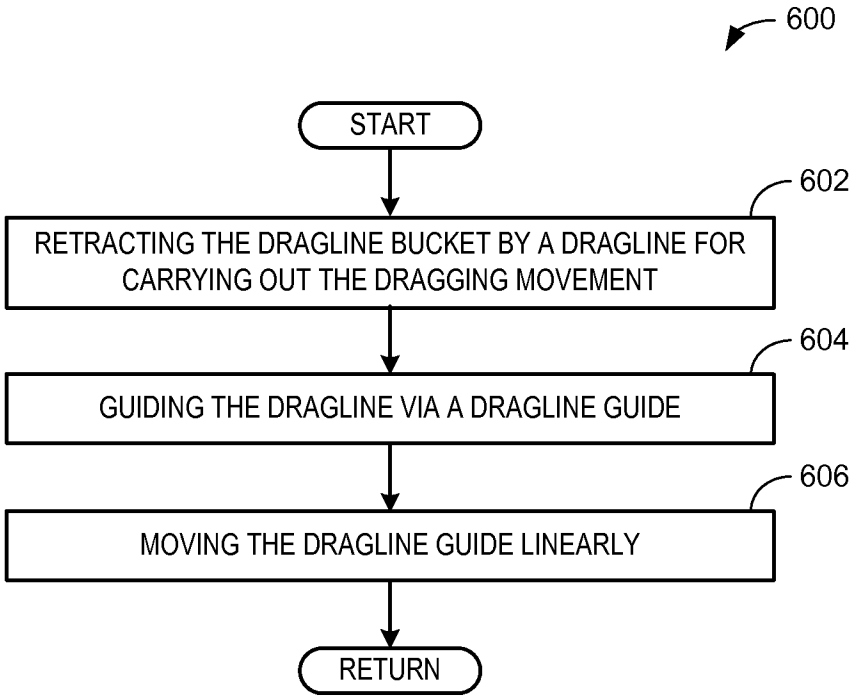
FIG. 6 shows a flowchart illustrating a method for operation of a work machine carrying out dragline bucket operation in accordance with the present disclosure.

The electronic controller in combination with the above described sensors and actuator elements carries the method 600 for a work machine carrying out dragline bucket operation illustrated in FIG. 6. The work machine may be a cable operated excavator including a linearly moveable dragline guide and where the dragline guide is moveable transversely to a dragline pulling direction. The work machine may also include at least one dragline winch having Lebus grooving as described above.

At 602, method 600 may include retracting the bucket by a dragline for carrying out dragging movement. At 604, method 600 may include guiding the dragline via a dragline guide. At 606, method 600 may include moving the dragline linearly such that the deflection angle of the dragline 40 on the dragline winch 41 amounts to zero degrees where possible or such that the maximum permitted deflection angle is not exceeded in any case.

The dragline guide in accordance with the present disclosure can be configured substantially shorter. Dragline winches 41 having a special grooving can also advantageously be used. The use of dragline winches 41 having a special grooving also allows the use of the dragline winch 41 with the dragline guide 50 at higher rope positions.

Note that the example figures may illustrate relative sizing and position of components with respect to each other. Further, the figures may illustrate components directly coupled to each other without intervening components; however, alternative couplings may be used, if desired. Further, the figures may illustrate components adjacent, above, below, behind, etc. with respect to one another, although alternative configurations may be used, if desired.

The invention claimed is:

1. A work machine for dragline bucket operation, comprising a dragline bucket taken up by a hoist rope, wherein the bucket is retractable by at least one dragline for carrying out a dragging movement and a dragline guide comprising a plurality of pulleys and roller bodies for guiding the dragline is arranged at the work machine, wherein the dragline guide is linearly movable in a horizontal direction, transverse to a dragline pulling direction, wherein an electronic controller is provided for controlling one or more drive elements, with the electronic controller taking account of a deflection angle of the dragline on a dragline winch; and wherein a roller head of the dragline guide comprising the plurality of pulleys and roller bodies is pivotable about a pivot angle of 360° relative to a tubular receiver.

2. The work machine in accordance with claim 1, wherein the work machine is a cable-operated excavator, and wherein the dragline guide is only linearly movable in the horizontal direction.

3. The work machine in accordance with claim 1, wherein the dragline is retracted by at least one dragline winch having Lebus grooving.

4. The work machine in accordance with claim 1, wherein the one or more drive elements are provided for generating the linear movement of the dragline guide in the horizontal direction.

5. The work machine in accordance with claim 4, wherein the one or more drive elements comprise a hydraulic cylinder.

6. The work machine in accordance with claim 1, wherein the dragline guide is automatically moved via the electronic controller.

7. The work machine in accordance with claim 5, wherein the electronic controller is configured such that an oblique pull of the dragline on the dragline winch is minimized by the control of the one or more drive elements.

8. The work machine in accordance with claim 1, wherein the dragline guide comprises at least one upper rope pulley and at least one lower rope pulley each having a horizontal axis of rotation.

9. The work machine in accordance with claim 1, wherein at least two oppositely disposed rollers are supported rotatably at a front rope inlet region of the dragline guide with a vertical axis of rotation, the vertical axis of rotation perpendicular to the horizontal direction.

10. The work machine in accordance with claim 1, wherein the dragline guide is releasably connectable to the work machine.

11. The work machine in accordance with claim 1, wherein the linear movement of the dragline guide in the horizontal direction is perpendicular to the dragline pulling direction.

12. The work machine in accordance with claim 1, wherein the dragline guide is fastened to a pivotal connection piece of a superstructure of the work machine, wherein the linear movement of the dragline guide in the horizontal direction is relative to a central axis of the pivotal connection piece, and wherein a base plate of the dragline guide is displaceable in the horizontal direction with respect to the pivotal connection piece by means of guide rails.

13. The work machine in accordance with claim 1, wherein the linear movement of the dragline guide in the horizontal direction is transverse to a guide direction of the dragline guide.

14. A method for a work machine carrying out dragline bucket operation, the work machine including a dragline bucket taken up by a hoist rope, comprising:

retracting the bucket by a dragline for carrying out a dragging movement;

guiding the dragline via a dragline guide, wherein the dragline guide comprises a roller head comprising pulleys, rollers, and side plates; and moving the dragline guide linearly in a horizontal direction that is transverse to a dragline pulling direction, where movement of the dragline guide is controlled by an electronic controller that takes into account an angle of the dragline with respect to a dragline winch;

wherein the electronic controller controls hydraulically releasable adjustment cylinders for adjustment of the dragline guide; and wherein the hydraulically releasable adjustment cylinders are connected to a pivotal connection plate and a base plate for horizontal displacement of the dragline guide relative to the pivotal connection plate.

15. The method of claim 14, wherein the work machine is a cable-operated excavator, wherein the dragline guide is only linearly movable in the horizontal direction, and wherein the dragline is retracted by at least one dragline winch having Lebus grooving.

16. The method of claim 14, wherein the linear movement of the dragline guide is automated, and where the linear movement of the dragline guide is generated via a drive element controlled by the electronic controller.

17. The method of claim 16, further comprising controlling the drive element in response to the angle of the dragline with respect to the dragline winch.

18. The method of claim 17, further comprising reducing, via the electronic controller, an oblique pull of the dragline on the dragline winch by adjusting the drive element.

19. The method of claim 14, wherein the linear movement of the dragline guide in the horizontal direction is perpendicular to the dragline pulling direction.

* * * * *